US005632668A

United States Patent [19]

Lindholm et al.

[11] Patent Number: 5,632,668

[45] Date of Patent: May 27, 1997

[54] METHOD FOR THE POLISHING AND FINISHING OF OPTICAL LENSES

[75] Inventors: Gene O. Lindholm, River Falls, Wis.; Robert A. Follensbee, Cottage Grove, Minn.

[73] Assignee: Minnesota Mining and Manufacturing Company, St. Paul, Minn.

[21] Appl. No.: 695,511

[22] Filed: Aug. 12, 1996

Related U.S. Application Data

[63] Continuation of Ser. No. 268,293, Jun. 29, 1994, abandoned, which is a continuation-in-part of Ser. No. 145,422, Oct. 29, 1993, abandoned.

[51] Int. Cl.[6] ..... B24B 1/00; B24B 7/19; B24B 7/30

[52] U.S. Cl. ..... 451/42; 451/296; 451/526

[58] Field of Search ..... 457/296, 526

[56] References Cited

U.S. PATENT DOCUMENTS

| | | | |
|---|---|---|---|
| Re. 29,808 | 10/1978 | Wagner | 51/401 |
| 1,941,962 | 1/1934 | Tone | 91/67.9 |
| 1,988,065 | 1/1935 | Wooddell | 91/68 |
| 2,001,911 | 5/1935 | Wooddell et al. | 51/190 |
| 2,015,658 | 10/1935 | Bezzenberger | 51/278 |
| 2,108,645 | 2/1938 | Bryant | 91/68 |
| 2,115,897 | 5/1938 | Wooddell et al. | 51/188 |
| 2,252,683 | 8/1941 | Albertson | 51/293 |
| 2,398,708 | 4/1946 | Hendrix . | |
| 2,755,607 | 7/1956 | Haywood | 51/185 |
| 2,806,772 | 9/1957 | Robie | 51/296 |
| 2,876,086 | 3/1959 | Raymond | 51/298 |
| 2,907,146 | 10/1959 | Dyar | 51/195 |
| 3,048,482 | 8/1962 | Hurst | 51/298 |
| 3,057,256 | 10/1962 | Erban | 88/28.93 |
| 3,211,634 | 10/1965 | Lorenzo | 204/16 |
| 3,517,466 | 6/1970 | Bouvier | 51/358 |
| 3,549,341 | 12/1970 | Kittredge et al. | 51/293 |
| 3,605,349 | 9/1971 | Anthon | 51/402 |
| 3,615,302 | 10/1971 | Rowse et al. | 51/295 |
| 3,631,638 | 1/1972 | Yoshikawa | 51/295 |
| 3,641,719 | 2/1972 | Yang | 51/402 |
| 3,661,544 | 5/1972 | Whitaker | 51/925 |
| 3,689,346 | 9/1972 | Rowland | 186/245 |
| 3,833,703 | 9/1974 | Joos | 264/167 |
| 3,859,407 | 1/1975 | Blanding et al. | 264/62 |
| 3,991,527 | 11/1976 | Maran | 51/397 |
| 4,011,358 | 3/1977 | Roelofs | 428/287 |
| 4,038,047 | 7/1977 | Haywood | 51/295 |
| 4,055,029 | 10/1977 | Kalbow | 51/395 |
| 4,106,915 | 8/1978 | Kagawa et al. | 51/296 |
| 4,255,164 | 3/1981 | Butzke et al. | 51/295 |
| 4,311,489 | 1/1982 | Kressner | 51/298 |
| 4,314,827 | 2/1982 | Leitheiser et al. | 51/298 |
| 4,318,766 | 3/1982 | Smith | 156/330 |
| 4,364,746 | 12/1982 | Bitzer et al. | 51/298 |
| 4,420,527 | 12/1983 | Conley | 428/172 |
| 4,456,500 | 6/1984 | Ibeta | 156/634 |
| 4,539,017 | 9/1985 | Augustin | 51/293 |
| 4,553,982 | 11/1985 | Korbel et al. | 51/298 |
| 4,576,612 | 3/1986 | Shukla et al. | 51/295 |
| 4,576,850 | 3/1986 | Martens | 428/156 |
| 4,587,291 | 5/1986 | Gardziella et al. | 524/595 |
| 4,588,258 | 5/1986 | Hoopman | 350/103 |
| 4,588,419 | 5/1986 | Caul et al. | 51/295 |
| 4,623,364 | 11/1986 | Cottringer et al. | 51/309 |
| 4,644,703 | 2/1987 | Kaczmaret et al. | 51/401 |
| 4,652,274 | 3/1987 | Boettcher et al. | 51/298 |
| 4,652,275 | 3/1987 | Bloecher et al. | 51/298 |
| 4,733,502 | 3/1988 | Braun | 51/406 X |
| 4,733,920 | 3/1988 | Chasman et al. | 51/295 |
| 4,735,632 | 4/1988 | Oxman et al. | 51/295 |
| 4,744,802 | 5/1988 | Schwabel | 51/309 |
| 4,751,138 | 6/1988 | Tumey et al. | 428/323 |
| 4,770,671 | 9/1988 | Monroe et al. | 51/293 |
| 4,773,920 | 9/1988 | Chasman et al. | 51/295 |
| 4,799,939 | 1/1989 | Bloeher et al. | 51/293 |
| 4,875,259 | 10/1989 | Appeldorn | 24/576 |
| 4,881,951 | 11/1989 | Wood et al. | 51/309 |
| 4,903,440 | 2/1990 | Larson et al. | 51/298 |
| 4,930,266 | 6/1990 | Calhoun et al. | 51/293 |
| 4,950,696 | 8/1990 | Palazotto et al. | 522/25 |
| 4,952,612 | 8/1990 | Brown-Wensley et al. | 522/25 |
| 4,959,265 | 9/1990 | Wood et al. | 428/343 |
| 4,983,458 | 1/1991 | Dejaiffe | 428/402 |
| 4,985,340 | 1/1991 | Palazotto et al. | 430/270 |
| 4,997,461 | 3/1991 | Markoff-Matheny et al. | 51/295 |
| 5,011,508 | 4/1991 | Wald et al. | 51/293 |
| 5,011,513 | 4/1991 | Zador et al. | 51/295 |

| | | | |
|---|---|---|---|
| 5,014,468 | 5/1991 | Ravipati et al. | 51/295 |
| 5,015,266 | 5/1991 | Yamamoto | 51/293 |
| 5,022,895 | 6/1991 | Wiand | 51/295 |
| 5,039,311 | 8/1991 | Bloecher | 51/295 |
| 5,061,294 | 10/1991 | Harmer et al. | 51/295 |
| 5,077,870 | 1/1992 | Melbye et al. | 24/452 |
| 5,078,753 | 1/1992 | Broberg et al. | 51/298 |
| 5,086,086 | 2/1992 | Brown-Wensley et al. | 522/25 |
| 5,090,968 | 2/1992 | Pellow | 51/293 |
| 5,093,180 | 3/1992 | Morgan | 428/156 |
| 5,107,626 | 4/1992 | Mucci | 51/281 |
| 5,131,926 | 7/1992 | Rostoker et al. | 51/309 |
| 5,147,900 | 9/1992 | Palazzotto et al. | 522/25 |
| 5,152,917 | 10/1992 | Pieper et al. | 51/295 |
| 5,174,795 | 12/1992 | Wiand | 51/295 |
| 5,178,646 | 1/1993 | Barber, Jr. et al. | 51/298 |
| 5,199,227 | 4/1993 | Ohishi | 51/395 |
| 5,201,101 | 4/1993 | Rouser et al. | 24/575 |
| 5,201,916 | 4/1993 | Berg et al. | 51/293 |
| 5,203,884 | 4/1993 | Buchanan et al. | 51/295 |
| 5,219,462 | 6/1993 | Bruxvoort et al. | 51/293 |
| 5,236,472 | 8/1993 | Kirk et al. | 51/298 |
| 5,273,805 | 12/1993 | Calhoun et al. | 428/156 |
| 5,304,223 | 4/1994 | Pieper et al. | 51/293 |
| 5,316,812 | 5/1994 | Stout et al. | 428/64 |
| 5,318,604 | 6/1994 | Gorsuch et al. | 51/293 |
| 5,368,619 | 11/1994 | Culler | 51/308 |
| 5,378,251 | 1/1995 | Culler | 51/295 |
| 5,435,816 | 7/1995 | Spurgeon et al. | 51/295 |
| 5,437,754 | 8/1995 | Calhoun | 156/231 |
| 5,453,312 | 9/1995 | Haas et al. | 428/143 |
| 5,454,750 | 10/1995 | Cosmano et al. | 451/526 |
| 5,454,844 | 10/1995 | Hibbard et al. | 451/296 |
| 5,489,235 | 2/1996 | Gagliardi et al. | 451/527 |
| 5,527,368 | 6/1996 | Supkis et al. | 51/298 |

FOREIGN PATENT DOCUMENTS

| | | |
|---|---|---|
| 2009718 | 8/1990 | Canada . |
| 004454A3 | 10/1979 | European Pat. Off. . |
| 109851B1 | 5/1984 | European Pat. Off. . |
| 168065A1 | 1/1986 | European Pat. Off. . |
| 345239A1 | 12/1989 | European Pat. Off. . |
| 0358383 | 3/1990 | European Pat. Off. . |
| 429269A1 | 5/1991 | European Pat. Off. . |
| 554668A1 | 8/1993 | European Pat. Off. . |
| 650807A1 | 5/1995 | European Pat. Off. . |
| 650803A1 | 5/1995 | European Pat. Off. . |
| 881239 | 4/1943 | France . |
| 2354373 | 1/1978 | France . |
| 57-121458 | 7/1982 | Japan . |
| 58-196974 | 11/1983 | Japan . |
| 61-244468 | 10/1986 | Japan . |
| 62-255069 | 11/1987 | Japan . |
| H2-83172 | 3/1990 | Japan . |
| 4-159084 | 6/1992 | Japan . |
| 6-190737 | 7/1994 | Japan . |
| 749650 | 7/1980 | U.S.S.R. . |
| 975375 | 11/1982 | U.S.S.R. . |
| 996178 | 2/1983 | U.S.S.R. . |
| 1316805 | 6/1987 | U.S.S.R. . |
| 1005448 | 9/1965 | United Kingdom . |
| 2043501 | 10/1980 | United Kingdom . |
| 2094824 | 9/1982 | United Kingdom . |
| WO92/15626 | 9/1992 | WIPO . |
| WO93/13912 | 7/1993 | WIPO . |
| WO93/12911 | 7/1993 | WIPO . |
| WO94/20264 | 9/1994 | WIPO . |
| WO94/27780 | 12/1994 | WIPO . |

OTHER PUBLICATIONS

"Irgacure® 369" Brochure of Ciba–Geigy Corp., 1993.

*Encyclopedia of Polymer Science and Technology,* vol. 8; John Wiley: New York; pp. 661–665 (1968).

J. V. Crivello, "Photoinitiated Cationic Polymerization", *Ann. Rev. mater. Sci.,* 13, 173–190 (1983).

K.L. Wilke et al., "Coated Abrasive Superfinishing: Predictable, Repeatable Texturing of Metal Roll Surfaces", from 3M Industrial Abrasives Division, Doc. No. A–ARLSF(92.05) BPH, May 1992 (8 pages).

"Gem Centerless Microfinishers", Brochure of Grinding Equipment & machinery Co., Inc., Youngstown, OH (published before Jan. 1, 1990).

"Superfinishing: The Microfinishing Systems Way", Brochure of 3M Microfinishing Systems, 6 pgs. (Jul. 14, 1988).

*Kirk–Othmer Encyclopedia of Chemical Technology, Third Edition,* vol. 1; John Wiley: New York; pp. 35–37 (1978).

V.A. Morozov, "How the Surface Relief of Abrasive Belts Affects Efficiency in Grinding Jobs", *Soviet Engineering Research,* 9, 103–107 (1989).

*Primary Examiner*—Robert A. Rose
*Assistant Examiner*—George Nguyen
*Attorney, Agent, or Firm*—Gary L. Griswold; Walter N. Kirn; Paul W. Busse

[57] ABSTRACT

A method for polishing an optical quality surface, such an ophthalmic lens, to finish which can accept a hardenable protective coating without using an abrasive slurry or gel, including the steps of: (a) providing an optical lens having a first major surface, the first major surface having an initial Rtm value of greater than 0.35 micrometers; (b) bringing the first major surface into a frictional contacting relationship with an abrasive article, wherein the abrasive article includes a sheet-like structure having deployed on at least one major surface thereof a plurality of individual abrasive composites, each composite having a plurality of abrasive particles dispersed in a binder; and (c) moving at least one of the contacting first major surface and abrasive article relative to each other with rotational and/or oscillatory movement in the presence of a liquid substantially free of abrasive particles in a manner and for a time effective to polish the first major surface to provide a final Rtm value in the first major surface of 0.30 micrometers or less.

33 Claims, 2 Drawing Sheets

METHOD FOR THE POLISHING AND FINISHING OF OPTICAL LENSES

This is a continuation of application Ser. No. 08/268,293, filed Jun. 29, 1994, abandoned which is a continuation-in-part of U.S. application Ser. No. 08/145,422, filed Oct. 29, 1993 abandoned.

BACKGROUND OF THE INVENTION

1. Field of the Invention

This invention relates to a method for polishing and finishing an optical quality surface with a structured or three-dimensional abrasive article which does not require an external loose grain abrasive slurry or gel.

2. Discussion of the Related Art

The grinding and polishing of optical quality surfaces are important processes in producing acceptable surfaces on optical components such as lenses, prisms, mirrors, and the like. For instance, the majority of today's population requires some form of corrective eye wear, and for many, this includes corrective eyeglasses.

Every prescription eyeglass lens, including those sunglasses and safety glasses, must be individually prepared for the specific customer. While plastic lenses may be the primary material which is polished, the processes described herein are also contemplated to be applicable to other optical quality materials, such as glass. One customary method of preparing an optical lens, namely, an ophthalmic lens, for the end user consists of several steps which include grinding, fining, polishing and hard coating. Each optical lens begins as a blank lens, into which the desired curvature is imparted by the series of steps.

As indicated above, a conventional production of a smooth finished lens surface involves three basic operations. The first step is rough grinding for curve generation using a tool having a preformed, curved surface which is plated or impregnated with diamond, tungsten carbide, or other superhard particles of the desired grit size. This tool is used to generate the desired radius or radii of curvature onto the lens form. The resultant lens surface usually is of the approximate curvature required, but is neither precise enough nor smooth enough to directly polish to the desired, final state. The next step, called "fining", in general, involves a preliminary finishing of the coarse ground surface to reduce deep scratches and provide a substantially smooth although not polished surface. The last step, called the "polishing" step, in general, involves fine grinding to remove scratches and provide a smooth, finished, or, in the case of an optical component, an optically clear surface which can receive a scratch-resistant hard coating, which is typically a curable polymer coating. This invention is concerned with the polishing step.

In somewhat greater detail, the fining step corrects the surface geometry of the lens to the exact requirement, and produces a surface texture that is smoothed sufficiently to enable the lens to be polished at a later stage from a generally milky, non-transparent state to a transparent state. Often, but not always, fining involves two separate fining steps as required in order to remove all previous scratches from the rough curve generation and produce a surface finish that is suitable for polishing with a loose abrasive slurry.

Abrasive products which are usually used for the fining operation are coated abrasives with aluminum oxide or silicon carbide abrasive particles for plastic lenses, or loose grain abrasives such alumina or silica carbide for glass lenses. The first fining step usually uses abrasive particles with a average particle size of 15 to 40 micrometers depending on the material and surface finish produced by the rough grinding step. The second fining step usually uses abrasive particles at least about 50% finer than the first, usually 4 to 12 micrometers. The time required for the two fining steps is usually from one minute to two minutes per step, depending on the starting surface finish, the abrasive particle size, and the desired resulting surface finish. The surface finish of the lens after the two fining steps typically can be anywhere from about 0.06 to 0.13 micrometer Ra, or an Rtm of from greater than 0.40 to about 0.90 micrometer.

Numerous attempts have been made to decrease the time necessary to obtain the desired surface finish and extend abrasive pad life during fining. For instance, U.S. Pat. No. 5,014,468 (Ravipati et al.) discloses a lapping film intended for ophthalmic applications comprising an interconnected pattern imparted into a surface coating of abrasive particles dispersed in a radiation cured adhesive binder.

Other prior abrasive articles for ophthalmic applications include single step fining pads, which are purportedly able to effect fining steps with a single pad in order to decrease time and cost. For instance, a one-step fining pad is disclosed in U.S. Pat. No. 4,644,703 to Kaczmarek et al. is said to provide a lens surface finish of not more than 0.25 micron AA (arithmetic average), which is understood to mean an Ra or so-called Average Roughness Height value, and not an Rtm value. Ra is the arithmetic average of the departures of the surface roughness profile from the mean line, while Rtm is defined as the mean of five individual roughness depths of five successive measuring lengths, where an individual roughness depth is the vertical distance between the highest and lowest points in the measuring length. By definition, Ra is typically measured over a significantly smaller distance than Rtm for a typical surface profile. Consistently, Kaczmarek et al. does not indicate that the lens could be successfully hard coated with a protective coating immediately after the fining operation described therein is performed.

On the other hand, U.S. Pat. No. 4,773,920 to Chasman et al. disclose a coated abrasive article useful as a lapping film where the abrasive material is formed as a dispersion of abrasive particles in a binder curable by free radical polymerization. The abrasive material is applied to a backing as a continuous coating and patterned, preferably by rotogravure roll, to provide a uniform pattern or an interconnected network of ridges with intervening grooves. The article is then cured. One use of the abrasive article exemplified in Chasman et al. is as a fining pad. A fining step, by definition, does not customarily impart the requisite final finish in the lens surface, namely, an exceedingly fine, mirror-like finish without wild or deep scratches in the surface of the lens workpiece. Therefore, further processing is typically required in this instance before the lens can receive a hard protective coating.

On the other hand, U.S. Pat. No. 4,255,164 to Butzke et al. disclose a glass fining sheet composed of a foamed liquid abrasive granule-resin coating composition. The liquid coating composition comprises a liquid curable binder, abrasive fining granules and sufficient compatible solvent to provide a coatable composition. Such a coating provides a cellular layer which releases the fining abrasive granules at a controlled rate under use conditions. Butzke et al. also describes a prior use of means to incorporate fining abrasive material into a cohesive layer so as to release abrasive material during glass grinding, but these means not having met with commercial success. Prior attempts are also mentioned to cause the binder to disintegrate, dissolve or soften to free abrasive granules, such as by adding lubricants such as stearic acid, tallow, and paraffin wax. However, these prior attempts are described as unsatisfactory as the binder material disintegrates too rapidly and problems arose with respect to unmanageable frictional heat generation.

Also, a commercially-available beaded 4 micrometer aluminum oxide abrasive article, designated 3M 356M Qwik Strip™ Fining Pad, manufactured by Minnesota Mining & Manufacturing, St. Paul, Minn. USA, is known for use as a fining pad which has been observed to provide a surface finish (Rtm) of about 0.44 micrometer on a polycarbonate plastic optical lens. Generally, a surface finish (Rtm) of about 0.44 micrometer is not considered a polished surface and is not a sufficient base for an acceptable hard protective coating.

After the fining step, the last step in a lens finishing procedure then becomes the polishing operation. In general, polishing conventionally has been accomplished with a loose slurry or gel containing abrasive particles which is externally introduced to the polishing site. This polishing step removes any remaining deep scratches and insures the transparent state of the lens surface, while maintaining the exact surface geometry. A typical polishing composition comprises 1 to 8 micrometers aluminum oxide particles dispersed in liquid medium such as water. The polishing time usually required with loose grain slurries is from 2 to 7 minutes per lens, again depending on the initial surface finish, the abrasive particle size, and the desired final surface finish.

There are many disadvantages associated with using an externally introduced loose grain abrasive slurry. These include the inconvenience of handling the required large volume of the slurry, the required agitation to prevent settling of the abrasive granules and to assure a uniform concentration of abrasive granules at the grinding interface, and the need for additional equipment to prepare, handle, and also recover and recycle the abrasive slurry. Additionally, the slurry itself must be periodically analyzed to assure its quality and dispersion stability which requires additional costly man hours. Furthermore, pump heads, valves, feed lines, grinding laps, and other parts of the slurry supply equipment which contact the slurry eventually show undesirable wear. Further, during usage, the polishing operation is usually a very untidy process because the loose granule slurry, which is usually applied as a viscous liquid to a soft pad, splatters easily and is difficult to contain.

Understandably, attempts have been made, generally without complete success, to use coated abrasive pads to replace loose granule slurry polishing systems because of the greater ease of use of such abrasive elements. For instance, U.S. Pat. No. 4,733,502 to Braun describes a method for grinding and polishing lenses on the same machine. Fining is performed with a fining pad having abrasive fining particles fixed in a non-water soluble matrix. Then, on the same surfacing machine spindle, polishing is said to be accomplished by use of a pad having a flexible water-soluble matrix containing an abrasive polishing powder, where the polishing particles are released during polishing in the presence of a stream of water. This polishing pad is described as preferably being a pad of the type disclosed in U.S. Pat. No. 4,576,612 to Shukla et al. However, Braun does not describe the actual surface finish provided by the method in terms of Ra or Rtm, or the like, nor does Braun indicate that the polished lens could be successfully hard coated with a hard protective polymer coating even after the polishing procedure.

Further, Shukla et al. describe ophthalmic lens polishing pad where the polishing layer is produced by mixing a water soluble polyalkylene oxide/phenolic resin complex with an acrylic latex, and an alcohol slurry containing polishing particles. The polishing layer in Shukla et al. is provided as a continuous monolithic layer on a fabric substrate, or, alternatively, as a layer to completely cover or partially fill recesses in an embossed surface of a fabric substrate.

The so-called thermoplastic matrix or binder system, including the latex, as described by Shukla et al., is said to gradually dissolve during polishing to release polishing particles in a controlled manner to thus reportedly provide an acceptable glass removal rate.

As indicated before, after polishing, it is now common practice that the lens is typically coated with a hard scratch-resistant polymeric coating before the lens is put into service. The polishing step must ensure that the final finish of the lens is acceptable for such a hard coating. If any wild swirls or deep scratches are left in the lens surface before applying the hard protective coating, the coating may not be able to fill the flaws and the lens would have to be rejected. Further, even if the hard coating fills the wild swirls or deep grooves left in a lens surface, a refractive index mismatch typically occurs between the hard coating in the scratch groove and the lens to impair the optical properties of the lens.

Therefore, there is a need for a more facile durable method for polishing optical components, especially for polishing ophthalmic lenses, which obviates the need to use external abrasive slurry or gel polishing techniques.

SUMMARY OF THE INVENTION

This invention relates to a method of finishing an optical quality surface to a suitable final polish finish without using an external abrasive slurry or gel. The present method provides an optical quality polished surface which can be successfully coated with a composition that on curing provides a hard, protective coating.

In one embodiment, this invention relates to a method for polishing an optical quality surface without using an externally-introduced abrasive grain slurry or gel comprising the steps of:

(a) providing an optical quality surface having a first major surface, said first major surface having an initial Rtm value of greater than 0.35 micrometers;

(b) bringing the first major surface into a frictional contacting relationship with an abrasive article, wherein the abrasive article includes a sheet-like structure having deployed on at least one major surface thereof a plurality of individual abrasive composites, each composite having a plurality of abrasive particles dispersed in a binder; and (c) moving at least one of the contacting first major surface and abrasive article relative to each other with rotational and/or oscillatory movement in the presence of a liquid which is substantially free of abrasive particles in a manner and for a time effective to polish the first major surface to provide a final Rtm value in the first major surface of 0.30 micrometers or less.

Additionally, in the present invention, it has been found, for a given lot of an abrasive article used in the present invention, that the method of the invention may provide a random individual data point(s) where the Rtm value is slightly higher in value than 0.30 micrometers. However, when more than one sample of abrasive article is tested from that given lot, the average (arithmetic) Rtm value has been experimentally observed to be a value of 0.30 micrometers or less, and even less than 0.30 micrometers in most cases.

By "given lot", it is meant that an abrasive article is made in a jumbo form having sufficient surface area dimensions to permit a plurality of discrete samples of the abrasive article, e.g., daisies, to be obtained from the abrasive article, and each sample is used in the polishing of a separate lens (same type of lens) and a separate Rtm is measured for each such polished lens. Therefore, the average Rtm value achieved by polishing the lenses according to the method of the present invention for a plurality of samples taken from a common abrasive article Jumbo form is 0.30 micrometers or less, and preferably less than 0.30 micrometers.

For purposes of this invention, an "optical quality surface" is a surface, such as an ophthalmic lens surface, that is transparent or can be conditioned to a transparent state and that will permanently adhere to a transparent hardenable coating. A "hardenable coating", and the like, is a coating material which can be rendered nonflowable at room temperature (about 25° C.).

For instance, in another embodiment of the invention, the method of the invention provides a first major surface in an optical quality surface which has a finish provided which receives and permanently adheres to a transparent hardenable polymer coating, such as a curable polysiloxane coating.

In a further embodiment, the aforesaid initial Rtm value is from about 0.40 to 0.90 micrometers. In another further embodiment of the invention, the final Rtm value achieved is less than 0.25 micrometers.

In another embodiment of the method of this invention, the optical lens polished by the invention is formed from a plastic, including a polycarbonate plastic, or a glass. The optical lens is typically transparent, particularly if the optical lens is an ophthalmic lens, after performing the polishing procedure of this invention. In this regard, the optical lens used in the method of the invention typically further has a second lens surface opposite the first lens surface, where the first lens surface is concavely shaped inwardly towards the second lens surface. The shape of the optical lens which can be polished by the method of the invention is not particularly limited, and includes an overall concavo-convex shape, and any conventional lens such as plus, minus or flat. These lenses can be polished on one side or both (sequentially) by the method of the invention.

In a further embodiment of the invention, the aforesaid sheet-like structure comprises a backing layer and the aforesaid binder comprises a thermosetting binder, wherein the thermosetting binder provides the means of attachment of the composites to the backing layer. Preferably, the thermosetting binder is formed by an addition polymerization mechanism, i.e. a free-radical or cationic polymerization of a binder precursor, and the binder precursor preferably is capable of being polymerized by exposure to radiation energy, along, if necessary, with an appropriate curing agent.

For instance, the binder precursor can be selected from the group consisting of (meth)acrylated urethanes, (meth) acrylated epoxies, ethylenically unsaturated compounds, aminoplast derivatives having pendant α, β-unsaturated carbonyl groups, isocyanurate derivatives having at least one pendant acrylate group, isocyanate derivatives having at least one pendant acrylate group, vinyl ethers, epoxy resins, and mixtures thereof.

In a further embodiment of the invention, the binder precursor is selected to be a mixture of vinyl ether having a molecular weight below 500 and a catalyst in an amount effective to initiate a cationic cure. This vinyl ether mixture can contain 10–80 parts by weight abrasive particles per 100 parts by weight of abrasive particles and vinyl ether.

In still another embodiment of the invention, the binder is a mixture of a thermosetting resin and a thermoplastic plasticizer. For example, the binder can be a blend of an acrylate monomer and a polyethylene glycol.

In another embodiment, the aforesaid abrasive particles have a size between about 0.05 to about 4 micrometers and a Moh's hardness of at least about 8, and they can be formed of an abrasive material selected from the group consisting of aluminum oxide, silicon carbide, chromia, silica, alumina zirconia, diamond, iron oxide, ceria, cubic boron nitride, boron carbide, garnet, and combinations thereof. The abrasive particles and the thermosetting binder can be provided in a proportional amount of 95:5 to 5:95 parts by weight, respectively, and more preferably, in a proportion of 50 to 90 parts abrasive particles and 10 to 50 parts binder.

In yet another embodiment of the invention, each aforesaid composite is provided to have a precise shape defined by a substantially distinct and discernible boundary, and each composite has a distal end which is unconnected to any other composite. That is, in this embodiment, the composites have free upper or distal ends to provide individual polishing action and the composites do not form an interconnected network of structures at their distal ends. In a further embodiment, each composite has a precise geometrical shape defined by a substantially distinct and discernible boundary, wherein the precise geometrical shape is selected from the group consisting of cubic, prismatic, conical, truncated conical, pyramidal, truncated pyramidal, and cylindrical.

The composites preferably have an area spacing on the major surface of at least 700 composites/cm$^2$. In one preferred embodiment, the height of the composites can be a value of up to about 200 micrometers especially 25 to about 200 micrometers. Also, where a pyramidal or truncated pyramidal shape is used as the composite shape, the base side lengths generally can have a length of from about 100 to 500 micrometers.

In one embodiment of the invention, the aforesaid sheet-like structure is a backing layer constituted by a material selected from the group consisting of polymeric film, woven cloth, paper, and nonwoven and treated versions thereof. A backing layer composed of a paper layer saturated with an acrylic latex resin and having a thickness of about 255 to 305 micrometers is preferred. It is also generally preferred that the backing be compressible. The abrasive article of the invention is generally flexible such that it can be readily conformed to the contour of a lap means.

In another embodiment of the invention, the sheet-like structure comprises a backing layer having a back side and an opposite front side for supporting the composites, wherein the back side includes means for attachment of the backing layer to a support means or a lap means. This attachment means is preferably a pressure-sensitive adhesive, although other methods are possible.

In an alternate embodiment of the invention, there is a method for polishing an optical quality surface without using an externally-introduced abrasive grain slurry or gel comprising the steps of:

(a) providing an optical quality surface having a first major surface, said first major surface having an initial Rtm value of greater than 0.35 micrometers;

(b) bringing the first major surface into a frictional contacting relationship with an abrasive article, wherein the abrasive article includes a sheet-like structure having deployed on at least one major surface thereof a plurality of abrasive particles dispersed in a binder, where the binder is formed from a binder precursor comprising an addition polymerizable resin;

(c) moving at least one of the contacting first major surface and abrasive article relative to each other with rotational and/or oscillatory movement in the presence of a liquid which is substantially free of abrasive particles in a manner and for a time effective to polish the first major surface to provide a final Rtm value in the first major surface of 0.30 micrometers or less.

In another alternate embodiment of the invention, there is also contemplated an abrasive article capable of providing a surface finish in an optical quality surface of 0.30 micrometers or less, where the abrasive slurry used to form the aforesaid abrasive composites is instead configured to form an interconnected grid or network of abrasive material on a backing, wherein the abrasive material is adhered to the backing in a discontinuous raised pattern formed of a plurality of elongated three-dimensional formations extending from the backing which define areas having no abrasive material.

In a further embodiment of the method of the invention, there is a method for finishing an optical lens mounted on a lens surfacing lap means without using an externally-introduced abrasive grain slurry or gel comprising the steps of:

(a) providing an optical lens having a first major surface, the first major surface having an initial Rtm value of greater than 1.0 micrometers;

(b) releasably securing on the lens surfacing lap means a first fining pad having abrasive particles fixed thereto;

(c) bringing the optical lens into frictional contact with the first fining pad and moving one of the optical lens and first fining pad with rotational and/or oscillatory movement in a manner and time effective to provide a first intermediate Rtm value in the first major surface of between 0.35 and 0.90 micrometer;

(d) removing the first fining pad from the lap means;

(e) optionally repeating steps (b), (c) and (d) except with a second fining pad having abrasive particles fixed thereto to provide a second intermediate Rtm value in said first major surface which is less in value than the than the first intermediate Rtm value and in the range of between 0.35 to 0.90 micrometer;

(f) releasably securing to the lap means an abrasive article comprising a flexible sheet-like structure having two opposing major surfaces comprising a back side and a front side, wherein a plurality of individual abrasive composites are deployed on the front side, each composite comprising a plurality of abrasive particles dispersed in a binder, the back side of the abrasive article in substantially conforming contact with the lap means;

(g) bringing the first major surface into a frictional contacting relationship with the abrasive article; and (h) moving at least one of the contacting first major surface and abrasive article relative to each other with rotational and/or oscillatory movement in the presence of a liquid in a manner and for a time effective to polish the first major surface to provide a final Rtm value in the first major surface of 0.30 micrometers or less. Preferably, the fining pad and abrasive article are each releasably secured to the lap means by attachment means comprising a pressure-sensitive adhesive. In another embodiment, the final Rtm value is less than 0.25 micrometers.

In yet another further embodiment of the invention, there is a method for polishing an optical quality surface without using an externally-introduced abrasive grain slurry or gel comprising the steps of:

(a) providing an optical quality surface having a first major surface, the first major surface having an initial Rtm value of greater than 0.35 micrometers;

(b) bringing the first major surface into a frictional contacting relationship with an abrasive article, wherein said abrasive article comprises a sheet-like structure having deployed on at least one major surface thereof a plurality of individual abrasive composites, each composite comprising a plurality of abrasive particles dispersed in a binder;

(c) moving at least one of the contacting first major surface and abrasive article relative to each other with rotational and/or oscillatory movement in the presence of a liquid in a manner and for a time effective to polish the first major surface to provide a final Rtm value in the first major surface of 0.30 micrometers or less; and (d) applying a hardenable coating material onto the first major surface, and hardening the coating material into a solid state. Preferably, the coating material is a curable polymer coating cured to the a solid state after application to the lens surface.

Other features, advantages, and further methods of practicing the invention will be better understood from the following description of figures and the preferred embodiments of the present invention.

DETAILED DESCRIPTION OF THE PREFERRED EMBODIMENTS

This invention pertains to a novel method of using an abrasive article in sheet-form for the final polishing step for an optical lens without the need to use an externally-introduced abrasive grain slurry or gel where is acceptable for receiving a hard protective coating.

Figure 1:
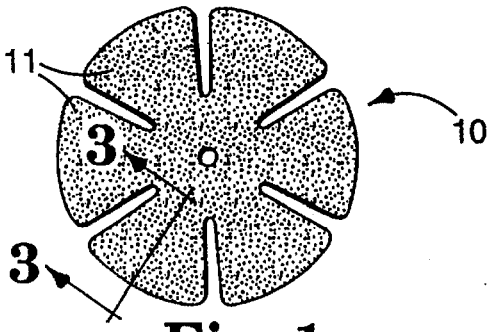
FIG. 1 is a top plane view of an abrasive article for use in the method of this invention.
Figure 3:
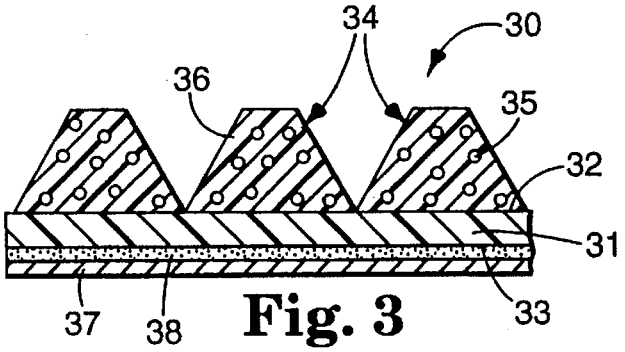
FIG. 3 is a enlarged sectional view taken along line 3—3 of the article shown in FIG. 1.

As illustrated in FIGS. 1 and 3, a flexible abrasive disc article 10 is provided by die-cutting an appropriate abrasive sheet into a "daisy" configuration to provide radially extended slots which define the side edges of petals 11. The "daisy" enables the abrasive disc article to conform and be securely fastened to a curved surface without undesirable puckering or creasing. The abrasive disc can have any number of petals, but usually numbers between 3 and 8 are satisfactory.

However, the form of the polishing article of the invention is not necessarily limited as long as the abrasive article can be easily conformed to a curved lap. The form can be any convenient shape for lens polishing operations such as the disc shape depicted in FIG. 1 or a modification thereof. A disc may be slotted or slitted, or may be provided with perforations. The pad may also have other shapes such as rectangular or oval, depending on the particular shape of the lap being employed. The sheet material also may be formed into an endless belt by conventional methods by splicing the abutted ends of an elongated strip of the sheet material. The preferred pad form has a plurality of radially aligned equally spaced slots extending from the edge of the pad toward its center.

Figure 2:
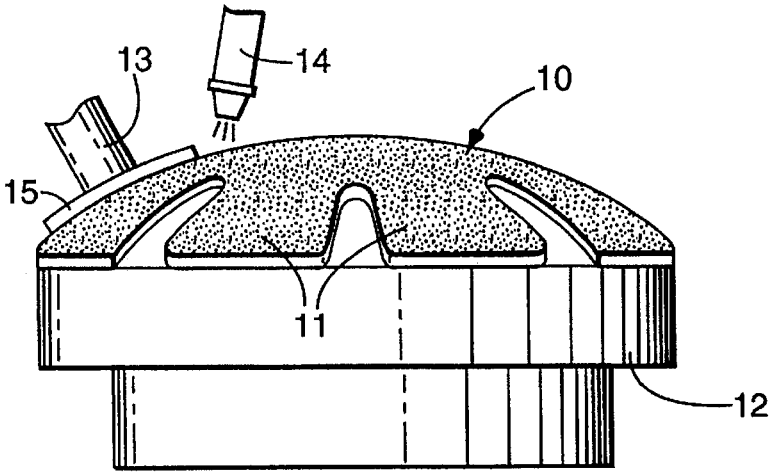
FIG. 2 is a side elevational view of a conventional surface machine lap having thereon a polishing sheet used in the present invention.

In FIG. 2, abrasive disc article 10 is placed on convexly-shaped lap means 12 with its abrasive surface facing outward, wherein the lap means has the curvature which is desired to be lapped into an optical lens. A lens blank 15 is then polished by placing the lens in contact with the abrasive disc article 10, and the lens 15 and lap 12 are moved respective to one another with rotational and/or oscillatory movement so that frictional contact occurs between the abrasive disc article 10 and the lens such that the surface of the lens is refined while fresh water or other aqueous solution is continuously supplied at a relatively high volume rate to the lens/sheet material interface. The lens 15 is urged against the lap means 12 by lens block or mount 13. Lens block 13 also can be a conventional lens block having a depression (not shown) for receiving the lens. It will be understood that the lens 15 and mount 13 are depicted in FIG. 2 in somewhat smaller scale relative to the size of the lap 12 in order to facilitate the view of the arrangement.

Referring to FIG. 3, abrasive article 30 of the invention is illustrated in greater detail and has a backing 31 having a plurality of individual abrasive composites 34 bonded to the front surface 32 of the backing and an attachment system, such as a pressure sensitive adhesive (not shown), on the back surface 33 of the backing. The abrasive composites 34 comprise a plurality of abrasive particles 35 dispersed in a binder 36. Layer 37 is a suitable release liner and can be peeled away to expose the pressure sensitive adhesive (PSA) layer or tape 38 coated on the back surface 33 of the backing 31.

Figure 4:
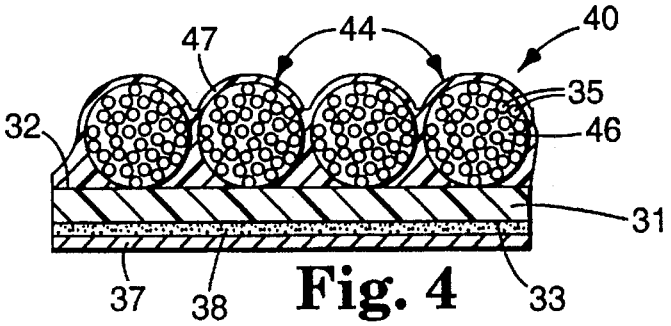
FIG. 4 is an enlarged sectional view of an alternative embodiment of an abrasive article that can be used in the method of this invention.

Referring to FIG. 4, abrasive article 40 of the invention has a backing 31 having a plurality of individual abrasive composites 44 bonded to the front surface 32 of the backing by bond system 47. The back surface 33 of the backing has an attachment system, such as pressure sensitive adhesive tape. The abrasive composites 44 are an agglomerate comprising a plurality of abrasive particles 35 dispersed in a binder 46. Layer 37 is a suitable release liner, and can be peeled away to expose a pressure sensitive adhesive layer or tape 38 coated on the back surface 33 of the backing 31.

For purposes of the present invention, the terminology "polishing" means removing previous scratches to provide an exceedingly fine, mirror-like finish without visually-identifiable wild or deep scratches in the surface of the lens workpiece. As another criteria of successful polishing in the method of the invention, the polished lens surface has an Rtm value of 0.30 micrometers or less as measured by a Perthen M4P profilometer having a 0.005 mm radius tip and a measuring stroke of 8 mm. This surface finish is need to ensure that the lens surface is free of wild swirls and deep scratches which would impair the optical properties of the lens. As another criteria of successful polishing in the method of the invention, a lens surface finish is provided having not more than 2.5 micrometers depth for the deepest single scratch within a standard traversal range of the surface measuring range.

For purposes of this invention, the expression "precisely-shaped", or the like, as used to describe the abrasive composites means a shape that is defined by relatively smooth-surfaced sides that are bounded and joined by well-defined sharp edges having distinct edge lengths with distinct end-points defined by the intersections of the various sides. Such precisely-shaped abrasive composites are generally formed by curing the curable binder of a flowable mixture of abrasive particles and curable binder while the mixture is both being borne on a backing and filling a cavity on the surface of a production tool.

For purposes of this invention, the term "boundary", as used to define the abrasive composites, means the exposed surfaces and edges of each composite that delimit and define the actual three-dimensional shape of each abrasive composite. These boundaries are readily visible and discernible when a cross-section of an abrasive article used in this invention is viewed under a scanning electron microscope. These boundaries separate and distinguish one abrasive composite from another even if the composites abut each other along a common border at their bases. By comparison, in an abrasive composite that does not have a precise shape, the boundaries and edges are not definitive, e.g., where the abrasive composite sags before completion of its curing.

Abrasive Article Backing

Examples of typical backings that can be used for the polishing abrasive article used in the method of this invention include polymeric film, primed polymeric film, cloth, paper, nonwovens and treated versions thereof and combinations thereof. Paper or cloth backings should have a water proofing treatment so that the backing does not appreciably degrade during the polishing operation, as water is typically used to flood the lap means during polishing in the practice of this invention.

It is desirable to use a compressible backing for the present invention. A relatively compressible backing is preferred in order to compensate for the change in lens radius from the fining step to the polishing step. It is also theorized that a more compressible backing helps to cushion the abrasive particles during polishing. This cushion effect may help to provide the relatively fine surface finish. In general, the backing thickness should range between 200 and 400 micrometers. The preferred backing for the present invention is a 10 to 12 mil (about 255 to 305 micrometer) thick paper backing saturated with an acrylic latex resin to increase water resistance. The backing typically is flat and nonembossed.

The backing may also have an attachment means on its back surface to secure the resulting coated abrasive to a support pad or back-up pad. This attachment means can be a pressure sensitive adhesive or tape, a loop fabric for a hook and loop attachment, or an intermeshing attachment system, such as described in U.S. Pat. No. 5,201,101, and incorporated herein by reference. Pressure sensitive adhesive or tape is preferably used as the means of attachment for ophthalmic lens polishing in the present invention. Examples of common pressure sensitive adhesives include acrylic polymers, acrylic homopolymers, acrylic copolymers, vinyl ethers, alkyl adhesives, rubber adhesives and mixtures thereof. Alternatively, these adhesives can be applied upon both surfaces of a thin backing layer to provide a pressure sensitive tape.

Abrasive Composite

The preferred abrasive article for use with the present invention employs an array of individual abrasive composites, each composite comprising abrasive particles dispersed in a binder system, as opposed to a continuous layer of abrasive particles dispersed in a binder. It is preferred that the composites be three dimensional, have work surfaces which do not form part of an integral layer and that present independent acting grinding surfaces from other composites during usage. These individual abrasive composites used in this invention can be used as a beaded type abrasive article or a so-called "structured abrasive article." A structured abrasive article means an abrasive article wherein a plurality of individual precisely-shaped composites are disposed on a backing in an array, each composite comprising abrasive particles dispersed in a binder. Examples of "individual" abrasive composites usable in this invention can be found in the following U.S. Pat. Nos. 4,930,266, 5,219,462 and 5,152,917. The structured abrasive article embodiment of this invention does not encompass a monolithic coating or a modified (e.g., embossed or discontinuous pattern) coating of abrasive particles dispersed in a binder.

During use of the abrasive article used in polishing of an optical lens for this invention, the abrasive composite gradually erodes. This erodibility property is helpful to obtain the fine surface finish on the lens surface. This erodibility allows worn abrasive particles to be expelled at a rate sufficient to expose new abrasive particles. It is believed that this erodibility rate prevents the old abrasive particles from creating deep and wild scratches in the lens surface.

This erodibility rate depends upon many factors including the abrasive composite formulation and the polishing conditions. Regarding the abrasive composite formulation, the abrasive particle type, abrasive particle size, binder type, optional additives, individually or in combination can effect erodibility of the abrasive composite. For instance, harder binders, such as phenolic binders, are less erodible than softer binders, such as aliphatic epoxy binders. Alternatively, certain additives or fillers, such as glass bubbles, tend to make the abrasive composite more erodible. In view of the disclosures herein, one skilled in the art could use routine skill to empirically obtain a satisfactory erodibility rate by monitoring the resulting surface finish.

It is also theorized that a softer abrasive composite helps the resulting abrasive article produce a finer surface finish in the workpiece. Although not desiring to be bound to any theory at this time, it is believed that the softer abrasive composite provides a cushion effect during polishing, thereby leading to a finer finish to help eliminate the need for an abrasive slurry.

There are several means to provide a soft abrasive composite. One means is to use a relatively soft binder, such as acrylate monomers, acrylated urethane oligomers, epoxies, vinyl ethers and the like. Generally, the soft binders will have a Knoop hardness less than about 25, generally less than about 20. These soft binders typically can enable the achievement of a sufficiently erodable composite system to be provided during polishing without the need for extraneous plasticizers to impart a requisite softness.

On the other hand, another means to provide a soft abrasive composite for this invention is to include a plasticizer in the abrasive composite. It is also believed that the plasticizer will affect the erodibility of the abrasive composite, and generally, it will increase the erodibility. The plasticizer should be compatible with the binder and binder precursor. The plasticizer should be uniformly mixed into the binder precursor and should not exude out of the abrasive slurry or coagulate within same. The weight ratio of the plasticizer mixed with a binder precursor can range from 10 to 50 parts, preferably 30 to 50 parts by weight plasticizer, per 100 parts by weight the combined binder precursor and plasticizer. The binder precursors preferably are those cured via addition polymerization, and are described elsewhere herein. Examples of suitable plasticizers include organic materials such as organo-silicone oils, glycerol, or a polyalkylene glycol. A preferred polyalkylene glycol is polyethylene glycol having an average molecular weight of from 200 to 10,000. Polyethylene glycol can be effectively used as a plasticizer together with trimethylolpropane triacrylate (TMPTA) as the binder precursor. However, plasticizers are not required in all cases to impart the desired erodibility property, as explained elsewhere herein.

Abrasive Particles

The abrasive particles used in the invention as dispersed in the composite binder have a particle size ranging from about 0.01 to 5 micrometers, usually between about 0.05 to 4 micrometers, preferably between 0.1 to 3 micrometers. It is preferred that the abrasive particles have a Mohs' hardness of at least about 8, more preferably above 9. Examples of such abrasive particles include fused aluminum oxide (which includes brown aluminum oxide, heat-treated aluminum oxide, and white aluminum oxide), ceramic aluminum oxide, green silicon carbide, silicon carbide, chromia, alumina zirconia, diamond, iron oxide, ceria, cubic boron nitride, boron carbide, garnet, silica and combinations thereof. Aluminum oxides are the preferred abrasive particle.

It is also within the scope of this invention to have a surface coating topcoated upon the abrasive particles. The surface coating may have many different functions. In some instances the surface coatings increase adhesion to the binder, alter the abrading characteristics of the abrasive particle and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like. On the other hand, abrasive particles, of the varieties and types described above, are not to be included or present in the liquid stream which is directed at the interface of the abrasive sheet article of the invention and lens surface during polishing.

Binder

The abrasive particles are dispersed in a binder to form the abrasive composite. The binder is a thermosetting or crosslinking binder, and preferably a binder curable by an addition (chain reaction) polymerization. The use in this invention of binder systems which cure via an addition mechanism provides significant advantages over thermoplastic binder systems as the former can be rapidly and controllably cured by exposure to radiation energy to permit a high rate of production while affording a high degree of control over ultimate shape of the abrasive composites. The thermosetting binder preferably is formed from a binder precursor.

Abrasive particles are mixed with the binder precursor to form an abrasive slurry. During the manufacture of the abrasive article, the abrasive slurry is exposed to an energy source which aids in the initiation of the polymerization or curing process of the binder precursor. Examples of energy sources include thermal energy and radiation energy which includes electron beam, ultraviolet light, and visible light.

Examples of suitable binder precursors which are curable via an addition (chain reaction) mechanism include binder precursors that polymerize via a free radical mechanism or, alternatively, via a cationic mechanism. These terms, such as "addition" or "chain reaction" mechanism, polymerization via a "free radical" or a "cationic" mechanism, have well known meanings, such as are explained in the *Textbook of Polymer Science*, third edition, F. Billmeyer, jr., John Wiley & Sons, New York, N.Y., 1984.

More particularly, suitable binder precursors for this invention which polymerize via free radical mechanism include acrylated urethanes, acrylated epoxies, ethylenically unsaturated compounds, aminoplast derivatives having pendant α,β-unsaturated carbonyl groups, isocyanurate derivatives having at least one pendant acrylate group, isocyanate derivatives having at least one pendant acrylate group, epoxy resins, and mixtures and combinations thereof. The term acrylate encompasses acrylates and methacrylates.

It has been discovered that plasticizer is not needed to impart the desired binder softness and erodibility in the abrasive composites if certain vinyl ethers are used as the binder precursor. These vinyl ethers polymerize via a cationic mechanism. In general, useful vinyl ethers include those which are difunctional and have a molecular weight below about 600, preferably below 500. The vinyl ether based binder resins can be cured with ultraviolet radiation in the presence of a photocatalyst which initiates a cationic cure. These vinyl ether resins can be loaded with up to 60% by weight abrasive particles of the types described herein. This abrasive slurry can be shaped into the array of abrasive composites by the production tooling techniques describe herein.

Vinyl ether monomers and oligomers can be blended to achieve a variety of cure speeds, extents of cure and crosslink densities, hence binders with different erodibility properties. Vinyl ethers cure cationically with no oxygen inhibition, and cure rapidly. It has been found that plasticizers are not needed to achieve a desirable level of erodibility when using the vinyl ether based binder system in the abrasive composites. Several low molecular weight vinyl ether monomers and oligomers with different cure properties have been observed to provide desirable erodibility in usage. Useful vinyl ether monomers are obtainable from ISP under the trade names Rapicure CHVE®, Rapicure DVE-3® and Rapicure PEPC®. Oligomer species that can be used included Vectomer 4020® and Vectomer 4030®, available from Allied Signal. The photocatalyst can be a triaryl sulfonium salt, such Cyracure UVI-6990® available from Union Carbide.

Two factors which are important in the design of an erodable binder are extent of cure and crosslink density of the cured coating. These two factors can be balanced by choosing an appropriate blend of vinyl ether monomers give a binder which erodes yet holds together during polishing. For example, Rapicure CHVE® cures very rapidly and forms a brittle and possibly erodable binder. By comparison, Rapicure DVE-3® cures more slowly and forms a soft coating which crumbles easily. However, both of these monomers shrink significantly during curing and may not always adhere well to paper. On the other hand, the Vectomer oligomers have a higher initial molecular weight which tends to reduce crosslink density, and they do not shrink as extensively and hence promote adhesion to paper. Blends of these vinyl ether monomers and oligomers, such as exemplified herein, can be formulated in a straightforward manner to provide the balance of adhesion and erodibility properties desired.

Although binder precursors which are curable via a free radical or cationic mechanism are preferred, other useful resins for this invention include condensation curable resins such as phenolic resins, urea-formaldehyde, and melamine formaldehyde resins. Phenolic resins, in some circumstances, can be desirable due to their thermal properties and cost. If phenolic resins are employed, it is preferred to use a mixture of the phenolic resin with a plasticizer, such as a polyester resin. However, The binder precursors which cure via free radical or cationic mechanism often are preferred due to the reduced solvent emissions associated with their usage.

However, in any event, it is not required in the present invention that the binder be complexed into any water soluble state with a plasticizer, if used; it is enough that the binder is merely physically intermixed with the plasticizer, if used, before introduction into the shaping or production tool for forming the abrasive composites. In fact, it has been observed, for example, that vinyl ether based binder systems provide satisfactory erodibility or polishing behavior in the practice of this invention without the need for any plasticizer being added.

Additives

The abrasive slurry can further contain optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired.

Examples of fillers used only for their effects on erodibility include, but are not limited to glass bubbles, alumina bubbles, polymer spheres, clay bubbles, marble, marl, gypsum, chalk, coral, coquina, oolite.

A coupling agent can provide an association bridge between the binder precursor and the filler particles or abrasive particles. Examples of coupling agents include silanes, titanates, and zircoaluminates. Also, the abrasive slurry preferably contains from about 0.01 to 3% by weight coupling agent.

An example of a suspending agent is an amorphous silica particle having a surface area less than 150 meters square/gram that is commercially available from DeGussa Corp., under the trade names "Aerosil 130" or "OX-50".

Abrasive Composite Shape

It is preferred that each abrasive composite has a precise shape associated with it. In one embodiment, the shape has a surface or boundaries associated with it that results in one abrasive composite being separated to some degree from another adjacent abrasive composite. That is, to form an individual abrasive composite, the planes and boundaries forming the shape of the abrasive composite must be separated from one another at least at the distal ends at the upper portions of the abrasive composite shapes.

These distal ends can all extend to a common imaginary plane extending parallel to the backing, or can have independent heights from each other. The lower or bottom portion of abrasive composites, but not inclusive of the distal ends, can abut next to one another. In this embodiment of the invention, the abrasive composites are "individual" in the sense that at least the distal ends of different composites do not interconnect. Typically, if the abrasive composites abut, no more than 10% of either contacting composite, based on the vertical height distance of either composite, is in physical contact. As a consequence, at least the distal ends present independent grinding surfaces against the workpiece. This proviso is thought to provide an array of separate more flexible grinding members to enhance the polishing effect. For instance, referring to FIG. 3, adjacent abrasive composites 34 are separated near the top surface and abutted near the bottom surface. Referring to FIG. 4, adjacent abrasive composites 44 may be completely separated near both the top surface and bottom surface.

The individual abrasive composite shapes can be any three dimensional shape, but it is preferably a geometric shape such as a cylinder, sphere, pyramid, truncated pyramid, cone, truncated cone, prism, cube, or a post-like feature having a top surface shape of triangle, square, rectangle, hexagon, octagon, or the like. Also, the resulting abrasive article can have a mixture of different abrasive composite shapes. A preferred shape is a pyramid or truncated pyramid. The pyramidal shape preferably has four to five sides if untruncted and five to six sides if truncated (inclusive of the base side), although a larger number of sides also is within the scope of the invention. It is preferred to provide a height of the composites which is constant across the abrasive article, but is possible to have composites of varying heights. The height of the composites can be a value of up to about 200 micrometers especially 25 to about 200 micrometers. Where a pyramidal or truncated pyramidal shape is used, the base side lengths generally can have a length of from about 100 to 500 micrometers.

The individual abrasive composites alternatively can be provided as abrasive agglomerates or beads, such as depicted in FIG. 4. These abrasive agglomerates are generally of the types described in U.S. Pat. No. 4,311,489 (Kressner; U.S. Pat. No. 4,652,275 (Bloecher et al.); and U.S. Pat. No. 4,799,939 (Bloecher et al.), which are incorporated herein by reference, but which are modified for purposes of this invention to increase the erodibility of the composite by means described herein.

Preferably, there should be at least 700 individual abrasive composites/square centimeter, preferably at least 1,500, more preferably at least 3,000 and most preferably at least 4,600 individual abrasive composites/square centimeter as the areal spacing of the composites on the backing sheet. These density numbers of abrasive composites result in an abrasive article that has a relatively high rate of cut, a long life, but also results in a relatively fine surface finish on the workpiece being abraded. Additionally, with this spacing number of abrasive composites there is a relatively low unit force per each abrasive composite. In some instances, this can result in better, more consistent, breakdown of the abrasive composite.

Alternatively, it is contemplated that the abrasive composites used in the invention can be formed as an interconnecting network on a backing as formed of a cured slurry of the abrasive particles dispersed in a binder of the types disclosed herein. The network can be a grid configuration where interconnected ridges of the abrasive material, such as applied to a backing by a rotogravure roll, enclose openings devoid of abrasive material. In this embodiment, the abrasive material is discontinuously applied to or formed on the backing to provide elongate ridges of abrasive material that are interconnected including at distal ends. This embodiment of the invention provides for a raised pattern of abrasive material, such as including the patterns mentioned in U.S. Pat. No. 4,773,920 and U.S. Pat. No. 5,014,468; although the abrasive material is modified for purposes of this invention by means disclosed herein to provide an erodable abrasive material, such as by the type and amount of plasticizer added as described herein, or by using a soft binder such as the vinyl ethers described herein, among others.

Method of Making the Preferred Abrasive Article

Figure 5:
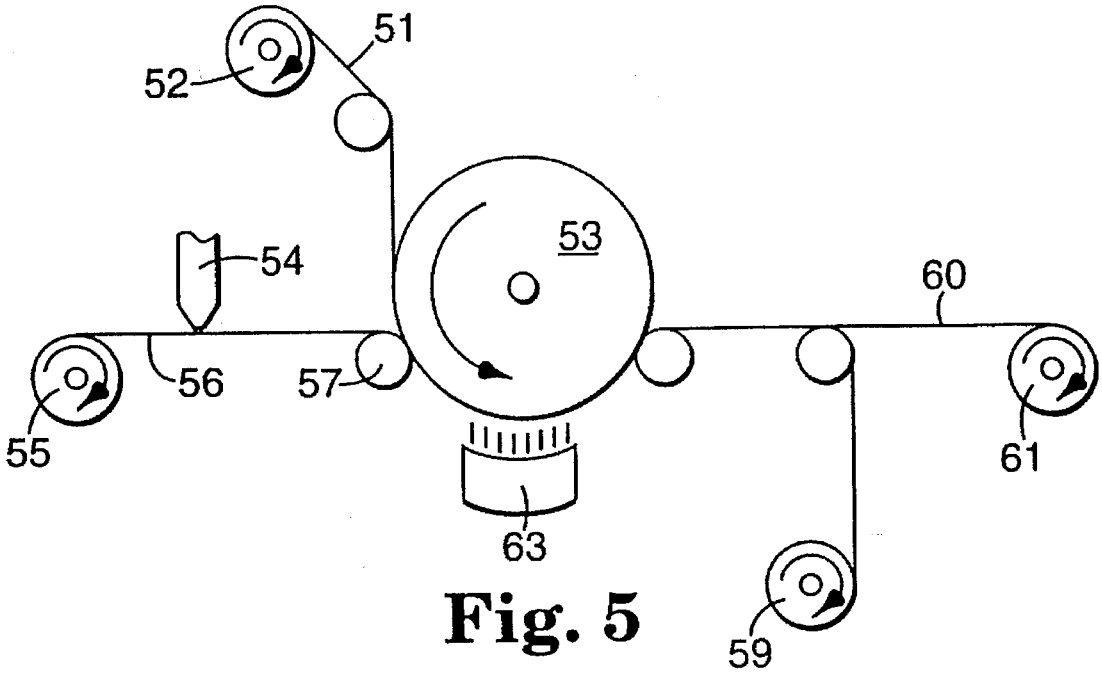
FIG. 5 is a schematic view of a system for making an abrasive article for use in this invention.

FIG. 5 is a schematic of the preferred abrasive article for use with this present invention. The first step to make the preferred abrasive article is to prepare the abrasive slurry. The abrasive slurry is made by combining together by any suitable mixing technique the binder precursor, the abrasive particles and the optional additives. Examples of mixing techniques include low shear and high shear mixing, with high shear mixing being preferred. The amount of air bubbles in the abrasive slurry can be minimized by pulling a vacuum during the mixing step. It is important that the abrasive slurry have a rheology that coats well and in which the abrasive particles and other additives do not settle out of the abrasive slurry. Any known techniques to improve the coatability, such as ultrasonics or heating can be used.

There are two main methods of making the abrasive article for this invention. The first, and preferred, method generally results in an abrasive composite that has a precise shape. To obtain the precise shape, the binder precursor is solidified or cured while the abrasive slurry is present in cavities of a production tool. The second method generally results in an abrasive composite that has an irregular shape.

In the second method, the abrasive slurry is formed into spheres or beads, or abrasive composites, such as available in a commercially available product 3M 356M Qwik Strip™ Fining Pad, manufactured by Minnesota Mining & Manufacturing, St. Paul Minn. USA, except that this pad was modified for purposes of this invention by using a 2.0 micrometer or less aluminum oxide abrasive particle instead of formerly used 4 micrometer particles. It was not formerly expected that the 356M Qwik Strip™ abrasive pad, commercialized as a fining pad, as modified herein or otherwise, would be applicable to the method of the present invention involving lens polishing procedures, much less provide a surface finish acceptable for hard coating without the need for using a loose abrasive slurry in another step in the polishing scheme.

The preferred method of producing the abrasive article to form precisely-shaped abrasive composites uses a production tool containing a plurality of cavities. These cavities are essentially the inverse shape of the desired abrasive composite and are responsible for generating the shape of the abrasive composites. The number of cavities results in the abrasive article having a corresponding number of abrasive composites/square unit area. These cavities can have any geometric shape such as a cylinder, dome, pyramid, truncated pyramid, prism, cube, cone, truncated cone or a post-like feature having a top surface shape of triangle, square, rectangle, hexagon, octagon, or the like. The dimensions of the cavities are selected to achieve this desired number of abrasive composites/square centimeter. The cavities can be present in a dot like pattern with spaces between adjacent cavities or the cavities can butt up against one another. It is preferred that the cavities butt up against one another.

The production tool can be a belt, a sheet, a continuous sheet or web, a coating roll such as a rotogravure roll, a sleeve mounted on a coating roll, or die. The production tool can be composed of metal, including a nickel-plated surface, metal alloys, ceramic, or plastic. Further information on production tools, their production, materials, etc. can be found in U.S. Pat. No. 5,152,917 (Pieper et al.), which is incorporated herein by reference, and U.S. Pat. No. 5,435,816 (Spurgeon et al.) filed Jan. 14, 1993. One preferred production tool is a thermoplastic production tool that is embossed off of a metal master.

When the abrasive slurry comprises a thermosetting binder precursor, the binder precursor is cured or polymerized. This polymerization is generally initiated upon exposure to an energy source. In general, the amount of energy depends upon several factors such as the binder precursor chemistry, the dimensions of the abrasive slurry, the amount and type of abrasive particles and the amount and type of the optional additives. The radiation energy sources include electron beam, ultraviolet light, or visible light. The radiation energy sources include electron beam, ultraviolet light, or visible light. Electron beam (ionizing) radiation can be used at an energy level of about 0.1 to about 10 Mrad, preferably at an energy level of about 0.1 to about 10 Mrad. Ultraviolet radiation refers to non-particulate radiation having a wavelength within the range of about 200 to about 400 nanometers, preferably within the range of about 250 to 400 nanometers. The preferred output of the radiation source is 118 to 236 Watt/cm. Visible radiation refers to non-particulate radiation having a wavelength within the range of about 400 to about 800 nanometers, preferably in the range of about 400 to about 550 nanometers.

A method of producing the preferred three dimensional abrasive is illustrated in FIG. 5. Backing 51 leaves an unwind station 52 and at the same time the production tool (cavitated tool) 56 leaves an unwind station 55. Production tool 56 is coated with abrasive slurry by means of coating station 54. The coating station can be any conventional coating means such as drop die coater, knife coater, curtain coater, vacuum die coater, or a die coater. During coating the formation of air bubbles should be minimized. The preferred coating technique is a vacuum fluid bearing die, which can be of the type such as described in U.S. Pat. Nos. 3,594,865; 4,959,265 and 5,077,870.

After the production tool is coated, the backing 51 and the abrasive slurry are brought into contact by any means such that the abrasive slurry wets the front surface of the backing. In FIG. 5, the abrasive slurry is brought into contact with the backing by means of contact nip roll 57. Next, contact nip roll 57 also forces the resulting construction against support drum 53. Next, some form of radiation energy, such as described herein, is transmitted into the abrasive slurry by energy source 63 to at least partially cure the binder precursor. For example, the production tool can be transparent material to transmit light radiation to the slurry contained in the cavities in the tool as the tool and backing pass over roll 53. The term partial cure is meant that the binder precursor is polymerized to such a state that the abrasive slurry does not flow from an inverted production tool. The binder precursor can be fully cured by any energy source after it is removed from the production tool. Following this, the production tool is rewound on mandrel 59 so that the production tool 56 can be reused again. Additionally, abrasive article 60 is wound on mandrel 61. If the binder precursor is not fully cured, the binder precursor can then be fully cured by either time and/or exposure to an energy source.

Other details on the use of a production tool to make the abrasive article according to this preferred method is further described in U.S. Pat. No. 5,152,917 (Pieper et al.), which is incorporated herein by reference, and U.S. Pat. No. 5,435,816 (Spurgeon et al.) filed Jan. 14, 1993.

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above. Relative to this method, it is preferred that the binder precursor is cured by radiation energy. The radiation energy can be transmitted through the backing or through the production tool. The backing or production tool should not appreciably absorb the radiation energy. Additionally, the radiation energy source should not appreciably degrade the backing or production tool. For instance ultraviolet light can be transmitted through a polyester backing.

Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. The more deformable material results in easier processing. For thermoplastic based production tools, the operating conditions for making the abrasive article should be set such that excessive heat is not generated. If excessive heat is generated, this may distort or melt the thermoplastic tooling.

After the abrasive article is made, it can be flexed and/or humidified prior to converting into the form of a daisy before the abrasive article is used.

Another method to make an abrasive article is to bond a plurality of abrasive agglomerates to a backing. These abrasive agglomerates comprise a plurality of abrasive particles bonded together to form a shaped mass by means of a first binder. The resulting abrasive agglomerates are then dispersed in a second binder precursor and coated onto a backing. The second binder precursor is solidified to form a binder and the abrasive agglomerates are then bonded to the backing.

The abrasive agglomerates can comprise the optional additives as discussed above and preferably contain a plasticizer. The abrasive agglomerates should have a desired rate of erodibility such that they break down during usage. Again, this erodibility rate can be determined by the abrasive particle type, first binder type, additive types and ratios thereof. Also, it is preferred that this abrasive agglomerate contain a plasticizer.

Abrasive agglomerates can be made by any conventional process such as those detailed in U.S. Pat. Nos. 4,311,489; 4,652,275 and 4,799,939, all incorporated herein by reference.

The abrasive agglomerates are dispersed in a second binder precursor to form an abrasive slurry. The remaining steps to make the abrasive article can be the same as that discussed herein. Alternatively, the abrasive slurry can be applied onto the backing as knife coated, roll coated, sprayed, gravure coated, die coated, curtain coated or other conventional coating techniques. Then the abrasive slurry is exposed to an energy source to cure the binder precursor and convert the abrasive slurry into an abrasive composite.

Method of Refining a Workpiece

The method of the present invention relates to polishing ophthalmic lenses with a fixed abrasive, three dimensional pad, rather than a loose abrasive slurry or gel. The workpiece for the present process is usually a plastic ophthalmic lens, although glass lenses are also within the scope of the invention. The plastic lens materials that can be polished by the present invention are not particularly limited, and include polycarbonates such as CR-39 manufactured by PPG, Pittsburgh, Pa. USA, polyesters, polyurethanes, polymethyl methacrylates, polystyrenes, and other high index materials known in the field.

After the second or final fining step, an Ra of about 0.06 to 0.13 micrometer, or an Rtm of 0.40 to 0.90 micrometer is usually obtained on the lens surface by using conventional fining pads. This surface finish level must be decreased to at least 0.30 micrometer Rtm after the polishing step in order for the surface to be rendered acceptable for hard coating. Additionally, wild scratches, swirl marks, or indentations are unacceptable and will result in a defective lens.

A polishing machine that can be used in the present invention can be any machine designed to accept a fixed abrasive pad, i.e., a lap means. Examples of lapping machines suitable for performing the polishing of the present invention include: Coburn 5000 cylinder machine or Coburn 5056 cylinder machine, both available from Coburn Optical Industries, Inc., Muskogee, Okla.; and other known machines in the industry. Unit pressures from about 0.7 to 1.8 kg/cm$^2$ are desired for the present process, with 1.3 to 1.5 kg/cm$^2$ being most preferred. However, the unit pressure is usually partially dictated by the polishing equipment used. The unit pressure on the abrasive article is believed to aid in the breakdown or erosion of the abrasive article being used, and this will be different for every type of abrasive article. Overall, the pressure used will depend on the polishing equipment used, the initial surface finish of the lens, the abrasive particle size, and the desired final surface finish of the lens.

The time devoted to lens polishing is usually 30 seconds to 6 minutes, with 2 to 3 minutes most common. The actual time needed for lens polishing depends on the pressure being used, initial surface finish of the lens, the abrasive particle size, and the desired final surface finish of the lens. An experienced machine operator will be able to determine the correct time and pressure required to obtain the desired final lens finish.

The lap means is flooded with water during the polishing procedure of the present invention. The aqueous flow applied in using the polishing sheet or pad of this invention is preferably predominantly water but may also include other ingredients as typically used in slurry polishing or in conventional coated abrasive finishing. Such additives may include water soluble oils, emulsifiable oils, wetting agents, and the like. The aqueous flow is at least essentially free of abrasive particles, and preferably contains no abrasive particles.

It is understood that no additional abrasive particles are applied to the liquid, the polishing is accomplished by the abrasive article. However, as the abrasive composites erode during polishing, naturally some worn abrasive particles liberated from these abrasive composites can or will be transitorily present in the liquid near the abrading work area until its drainage but are not present in the liquid as initially applied.

The water flow supplied at the interface of the polishing sheet and lens being polished should be relatively large in volume, in order to "flood" the polishing surface, i.e., be used in an amount adequate to cover substantially all surfaces at the abrading interface. A water hose and nozzle can be directed at the interface to provide the water present at the interface during polishing.

After the optical lens is polished to a surface finish of no greater than 0.30 micrometer Rtm according to the present invention, a hard scratch-resistant coating can be coated over the polished surface of the lens to protect the finish. This scratch-resistant coating preferably is a curable polymer material which can be cross-linked upon exposure to irradiation by a thermal or light source. Polysiloxane materials known in the field for this purpose can be used. Suitable hard coatings include commercially available materials such as Ultra Optics' hardcoat manufactured by Ultra Optics Co. of Minneapolis Minn. USA, and coatings, such as TI-325, manufactured by Lens Technology Inc. of Torrance, Calif. USA. The hard coat also could be provided by sputtering upon the lens surface.

The following non-limiting examples will further illustrate the invention. All parts, percentages, ratios, and the like, in the examples are by weight unless otherwise indicated.

EXAMPLES

The following abbreviations are used throughout:

TMPTA: trimethylol propane triacrylate, available from Sartomer under the trade designation "SR 351";

PEG: polyethylene glycol, commercially available from Union Carbide under the trade designation Carbowax "600";

PH2: 2-benzyl-2-N,N-dimethylamino-1-(4-morpholinophenyl)-1-butanone, commercially available from Ciba Geigy Corp. under the trade designation Irgacure 369;

ASF1: amorphous silica filler, commercially available from DeGussa under the trade designation "Aerosil 130";

ASF2: amorphous silica filler, commercially available from DeGussa under the trade designation "Aerosil 812";

WAO: white aluminum oxide, JIS grade 6000, 2 micrometers average particle size, available from Fujimi Corp.;

WAB: agglomerated white aluminum oxide (average particle size 2 micrometers), mixture of grade 40/170, 170/200 and 200 mesh;

SCA: silane coupling agent, 3-methacryloxypropyl trimethoxysilane, commercially available from Union Carbide under the trade designation "A-174";

PMR: a phenolic resin system, made by a process described below;

RV: 1,4-cyclohexanedimethanol divinyl ether, commercially available from International Speciality Products (ISP) Wayne, N.J., under the trade designation "Rapicure CHVE";

RP: propenyl ether of propylene carbonate, commercially available from International Speciality Products (ISP) Wayne, N.J., under the trade designation "Rapicure PEPC";

RD: triethylene glycol divinyl ether, commercially available from International Speciality Products (ISP) Wayne, N.J., under the trade designation "Rapicure DVE-3";

RH: hydroxybutyl vinyl ether, commercially available from International Speciality Products (ISP), Wayne, N.J., under the trade designation "Rapicure HBVE".

V2: vinyl ether terminated ester monomer, MW 436, viscosity 430 centipoise, commercially available from Allied Signal, Morristown, N.J., under the trade designation "Vectomer 4020";

V3: vinyl ether terminated ester monomer, viscosity 75 centipoise, commercially available from Allied Signal, Morristown, N.J., under the trade designation "Vectomer 4030";

IC: cationic photoinitiator, triaryl sulfonium salt, commercially available from Union Carbide, under the trade designation "Cyracure UVI-6990".

Method of Preparing PMR

The following was thoroughly dispersed together, in no particular order: 15.84 parts deionized water, 0.72 part "Poly-Solv" commercially available from Olin Chemicals of Stamford, Conn., 12.60 parts acetone, 5.30 parts glycol ether solvent, 29.77 parts resole phenolic resin (containing 2 to 4% free phenol, formaldehyde to phenol ratio of about 1.8:1, and 70% solids), 7.39 parts PEG, 14.02 parts amorphous silica clay, 12.17 parts methyl ethyl ketone, 0.78 parts "Bentone SDI" and 0.78 part "Bentone 38" both available from National Lead Company.

Test Procedure 1

Test Procedure 1 was designed to test the abrasive article for ophthalmic lens polishing. The abrasive samples, as made according to the following examples, were cut with a standard die into 3 inch (about 7.6 cm) diameter "daisies". The lens workpiece was made of "CR-39" plastic, made by Pittsburgh Paint & Glass (PPG), Pittsburgh, Pa. USA, which was made into a semi-finished 68 mm hard resin lens available from SOLA Optical, USA, Petaluma Calif., unless indicated otherwise in the following examples. It was 68 mm in diameter and was pre-ground to a 212 spherical curve (2.12 Diopter). The backside of the abrasive material to be tested was laminated with a pressure-sensitive adhesive tape and clamped over a lapping block. The polishing machine used was a Coburn 5000 cylinder machine, unless indicated otherwise in the following examples, available from Coburn Optical Industries, Inc., Muskogee, Okla. USA, with the polishing machine having a setting of 20 pounds force (about 4.5 Newton) and used to urge the lap means and abrasive article against the surface of the lens workpiece. The lap block and lens was flooded with water during polishing. The water flooding was effected by projecting a continuous stream of water into the interface of the contacting lap block and lens workpiece.

A two step fining operation was first performed, unless otherwise indicated in the following examples. The lens was fined for one minute with a 15 micrometer silicon carbide paper, designated 3M 416M Qwik Strip™ Fining Pad, commercially available from Minnesota Mining and Manufacturing, St. Paul, Minn. USA, and followed by two minutes with a 4 micrometer aluminum oxide beaded lapping film commercially available from Minnesota Mining and Manufacturing under the trade designation 3M 356M Qwik Strip™ fining pad. The exemplary polishing abrasive article material(s), described below, was then used to polish the lens for two minutes under the otherwise same conditions as the second fining step.

Rtm

Rtm is a common measure of roughness used in the abrasives industry; it is defined as the mean of five individual roughness depths of five successive measuring lengths, where an individual roughness depth is the vertical distance between the highest and lowest points in a measuring length. Rtm was measured with a profilometer probe, which is a diamond tipped stylus, and the results are recorded in micrometers. In general, the lower the Rtm, the smoother the finish. A slight variation in the absolute Rtm value can, but not necessarily, occur when the measurement on the same finished lens surface is performed on different brands of commercially available profilometers.

For purposes of the characterizing the abrasive article used in this invention, the Rtm measurements are determined by a profilometer which is a Perthen M4P, available from Feinprof Perthen GMBH, Gottingen, Germany, with a 0.005 mm radius tip and a measuring stroke of 8 mm.

Examples 1 and 2

Abrasive articles for Examples 1 and 2 were prepared from the abrasive slurry formulations described in Table 1.

TABLE 1

| | Example 1 | Example 2 |
|---|---|---|
| TMPTA | 38.4 | — |
| 70/30 TMPTA/PEG | — | 38.4 |
| PH2 | 0.39 | 0.39 |
| SCA | 1 | 1 |
| ASF1 | 1.5 | 1.5 |
| WAO | 38.7 | 58.7 |

The abrasive article for each of Example 1 and Example 2 was made by a scheme generally depicted in FIG. 5. In particular, for each of Example 1 and 2, the abrasive slurry was coated via a knife coater at a speed of about 4.6 meters/minute onto a polypropylene production tool having a truncated pyramidal type pattern such that the abrasive slurry filled recesses in the tool. The amount of slurry is fed in slight excess to provide a bead of excess slurry on the tooling above nip roll 57, which helps facilitate later separation of the backing from the production tooling. The pyramidal pattern was such that their adjacent bases were spaced-apart from one another a shortest distance of about 510 micrometers. The height of the truncated pyramids was about 80 micrometers (3.15 mils), the base was about 178 micrometers (7 mils) per side, and the top was about 51 micrometers (2 mils) per side. There were 125 lines per inch (about 49 lines per centimeter) delineating the array of composites. A 250 micrometer thick paper backing was pressed against the production tool by means of a roller and the abrasive slurry wetted the front surface of the backing. The article was cured by passing the tool together with the backing and binder precursor once under a 600 W/in (236 watt/cm) "V-bulb" (available from Fusion Systems Co.) at a speed of about 45.7 meters/minute. The radiation passed through the production tool. This visible light resulted in the abrasive slurry being transformed into an abrasive composite and the abrasive composite being adhered to the paper substrate. Next, the paper/abrasive composite construction was separated from the production tool to form an abrasive article.

Comparative Example A

Comparative Example A involved polishing with an aluminum oxide loose slurry, 2.5 micrometer average particle size, commercially available from Transelco Co., Penn Yan, N.Y., USA, under the trade designation "Micronal Supreme 700". The slurry was placed on a soft polishing pad and Test Procedure 1 was run.

Table 2 below shows the initial and final Rtm values (in micrometers) of the lenses before and after polishing, respectively, for Examples 1 and 2 and Comparative Example A when tested according to Test Procedure 1.

TABLE 2

| | Initial Rtm | Final Rtm* |
|---|---|---|
| Example 1 | 0.54 | 0.28 |
| Example 2 | 0.44 | 0.23 |
| Comparative Example A | 0.28** | 0.10** |

*The Rtm was determined as an average value of 6–8 readings.

**The Rtm values were measured for the comparative example using a known laser profilometer available from UBM Corporation, Roselle, NJ, instead of the Perthen M4P Perthometer used for Examples 1, 2.

The results show that the use of the abrasive article in sheet-form in the present invention, while not as low as the comparative example using a loose abrasive slurry, nonetheless provides a finish or surface roughness below 0.30 micrometers which is acceptable for receiving a hard protective coating without the need to use a bothersome and untidy abrasive slurry or gel.

Example 3

Example 3 was prepared by mixing 6.3 parts WAB, which was modified to the extent that 1 micrometer white aluminum oxide was used, with 100 parts PMR. This abrasive slurry was knife coated (using a 127 micrometer knife gap) onto a 250 micrometer thick paper backing such as used in Examples 1 and 2. The slurry preparation and treatment was otherwise the same as that described in Examples 1 and 2.

The abrasive articles formed and a lens were tested in a polishing procedure as described above on a Coburn 5000 cylinder machine for a period of 2 minutes. For Rtm-1 in Table 3, the Rtm (in micrometers) of the polished lens was measured with a Perthen M4P Perthometer as an "average" Rtm by averaging 6–8 measurements, instead of five measurements, taken at various random locations on the lens, although each measurement was taken at approximately the same distance from the edge of the lens. For Rtm-2, the same profilometer was used to measure the surface roughness of the polished lens, except that two readings were taken across the length of the base curve; the second reading being taken perpendicular to the first reading, with these respective two readings for Rtm-2 indicated in Table 3.

TABLE 3

| | Rtm-1 | Rtm-2 |
|---|---|---|
| Example 3 | 0.195 | 0.136/0.127 |

The results show that the method of the present invention assuredly provides Rtm values under 0.30 micrometers over the expanse of the polished lens to even better ensure receivability of a hard protective coating.

Examples 4–7

The use of an abrasive article of this invention as a polishing pad using vinyl ether based binder systems without plasticizers in the abrasive composites also was evaluated.

The abrasive slurries described below were knife coated on top of a production tool having 80 micrometer deep pyramidal cavities provided therein and attached to a 250 micrometer paper backing. The base of the pyramidal cavities was about 178 micrometers per side, and the top was about 51 micrometers per side. There were about 125 lines per inch (about 49 lines per centimeter) delineating the array of composites. The pyramidal pattern was such that their adjacent bases were spaced-apart from one another about 25 μm.

The following binder precursor formulations BP1, BP2, and BP3 were prepared with the components described in Table 4. Amounts are given in parts by weight.

TABLE 4

| component | BP1 | BP2 | BP3 |
|---|---|---|---|
| RV | 25 | 50 | 9 |
| RP | 10 | 20 | — |
| RD | 25 | — | 59 |
| V2 | 20 | 30 | — |
| V3 | 20 | — | 32 |
| IC | 1.7 | 1.7 | 1.7 |

The abrasive slurry for Example 4 was prepared with 53.2 parts WAO, 44.4 parts BP1, 1.4 parts ASF2, and 1 part SCA.

The abrasive slurry for Example 5 was the same as Example 4, except that BP2 replaced BP1.

The abrasive slurry for Example 6 was the same as Examples 4 and 5, except that BP3 replaced BP1 and BP2, respectively. Example 6 was duplicated to provide the same abrasive slurries for two separate runs, Examples 6A and 6B. Example 6A was coated and cured at a line speed of 6 meters/minute, and Example 6B was coated and cured at a line speed of 23 meters/minute.

For Example 7, the binder precursor formulation BPA was prepared with 60 parts TMPTA, 40 parts PEG, and 1.0 part PH2. The abrasive slurry composition prepared for Example 7 was a mixture of 49 parts WAO; 49 parts BPA; 1.0 parts ASF1 and 1.0 parts SCA, all parts being by weight.

The following parameters were employed on a production line, such as generally depicted in FIG. 5, to form the abrasive sheet articles of Examples 4–7. The coating and curing speed was 6 meters/minute for Examples 4, 5, 6A, 15 meters/minute for Example 7, and 23 meters/minute for Example 6B. The coating station was a knife coater with a 51 micrometer gap.

The mandrel was heated to about 60° C. The binder precursor curing was done by a 600 W/in (236 watt/cm) "D Bulb" available from Fusion Systems.

The Examples 4–7 were then tested in the same manner as Test Procedure 1, except that the machine used was a Coburn 5056 cylinder machine, and the lens was fined with only one step, the 4.0 micrometer aluminum oxide bead lapping film, commercially available as 3M 356M Qwik Strip™ Fining Pad. The fined lenses, on average, had an Rtm of about 0.42 micrometers, and above 0.39 micrometers in all cases. The lenses were then polished with the abrasive articles of Examples 4–7 according to the conditions of Test Procedure 1. Two or three separate lenses were polished with two or three separate samples, i.e. daisies, respectively, obtained from the abrasive article of each of Examples 4–7 to determine an average value for each example, as indicated in Table 5. The Rtm results from the tests, recorded in micrometers, are summarized in Table 5 below.

TABLE 5

| Run | Rtm 1 | Rtm 2 | Rtm 3 | Rtm ave. |
|---|---|---|---|---|
| Example 4 | 0.28 | 0.23 | 0.27 | 0.26 |
| Example 5 | 0.27 | 0.29 | — | 0.28 |
| Example 6A | 0.32 | 0.28 | 0.28 | 0.29 |
| Example 6B | 0.25 | 0.29 | — | 0.27 |
| Example 7 | 0.18 | 0.20 | — | 0.19 |

As shown by these results, the vinyl ether binder systems not containing plasticizers also provide abrasive composites which provide polishing characteristics in Rtm of less than 0.30 micrometers, which is a surface finish acceptable for hard coating.

Examples 8–11

Further tests on the use of an abrasive article of this invention as a polishing pad using vinyl ether based binder systems without plasticizers in the abrasive composites were conducted as follows.

Additional binder precursor formulations were prepared with the components described in Table 6. Amounts are given in parts by weight.

TABLE 6

| Component | BP4 | BP5 | BP6 | BP7 |
|---|---|---|---|---|
| RV | — | 45.1 | 25.0 | — |
| RP | — | 18.0 | 10.0 | — |
| RD | 54.8 | — | 20.0 | — |
| RH | 5.0 | 9.8 | 8.0 | — |
| V2 | — | 27.1 | — | — |
| V3 | 40.2 | — | 37.0 | — |
| IC | 2.0 | 1.5 | 1.5 | — |

TABLE 6-continued

| Component | BP4 | BP5 | BP6 | BP7 |
|---|---|---|---|---|
| PEG | — | — | — | 40.0 |
| TMPTA | — | — | — | 60.0 |
| PH2 | — | — | — | 1.0 |

The abrasive slurry for Example 8 was prepared with 53.0 parts WAO, 44.6 parts BP4, 1.4 parts ASF2, and 1 part SCA. The abrasive slurry of Example 8 was coated and cured at a line speed of 15.24 meters/minute.

The abrasive slurry for Example 9 was the same as Example 8, except that BP5 replaced BP4. The abrasive slurry of Example 9 was coated and cured at a line speed of 15.24 meters/minute.

The abrasive slurry for Example 10 was the same as Example 8, except that BP6 replaced BP4. The abrasive slurry of Example 10 was coated and cured at a line speed of 4.57 meters/minute.

The abrasive slurry for Example 11 was the same as Example 8, except that BP7 replaced BP4. Example 11 was coated and cured at a line speed of 15.24 meters/minute.

The abrasive slurries were employed on a production line, such as generally depicted in FIG. 5, to form the abrasive sheet articles of Examples 8–11. More particularly, the abrasive slurries of Examples 8–11 were coated into a polypropylene production tool and then transferred onto 250 micrometer thick paper. The coating station was a knife coater with a 51 micrometer gap. The production tool used for Examples 8–11 was identical to the one used for Examples 1 and 2.

The mandrel was heated to about 60° C. The binder precursor curing was done by a 600 W/in (236 watt/cm) "D Bulb" available from Fusion Systems.

The Examples 8–11 were then tested in the same manner as Test Procedure 1, with the following changes: the machine used was a Coburn 5056 cylinder machine, the lens workpiece was made of polycarbonate plastic, available from Vision-Ease, St. Cloud, Minn. (68 mm in diameter and was pre-ground to a 212 spherical curve (2.12 Diopter), and the lens was fined with only one step for one minute with a Grade 1000 3M 314 Qwik Strip™ fining pad (designated P1000 A/O), commercially available from 3M Company, St. Paul, Minn., to a finish of about 0.98 micrometers. The lenses were then polished with the abrasive articles of Examples 8–11. The Rtm values (in micrometers) for the polished lenses of all of the respective runs of Examples 8–11 are summarized in Table 7 below.

Two or three separate lenses were polished with two or three separate samples, i.e. daisies, respectively, obtained from the abrasive article of each of Examples 8–11 to determine an average value for each example, as indicated in Table 7. The Rtm results from the tests, recorded in micrometers, are summarized in Table 7 below.

TABLE 7

| Test | Rtm 1 | Rtm 2 | Rtm 3 | Rtm ave |
|---|---|---|---|---|
| Example 8 | 0.29 | 0.30 | — | 0.295 |
| Example 9 | 0.11 | 0.13 | — | 0.12 |
| Example 10 | 0.11 | 0.13 | — | 0.12 |
| Example 11 | 0.30 | 0.23 | 0.28 | 0.27 |

As shown by these results, the vinyl ether binder systems not containing plasticizers provided abrasive composites which provide polishing characteristics in Rtm of 0.30 micrometers or less, which is a surface finish acceptable for hard coating.

Examples 12–14

Even further tests on the use of an abrasive article of this invention as a polishing pad using vinyl ether based binder systems without plasticizers in the abrasive composites were conducted as follows.

Additional binder precursor formulations were prepared with the components described in Table 8. Amounts are given in parts by weight.

TABLE 8

| Component | BP8 | BP9 |
|---|---|---|
| RV | 60 | 45 |
| RP | 24 | 18 |
| RH | 11 | 10 |
| V3 | 5 | 27 |
| IC | 2.0 | 2.0 |

The abrasive slurry of Example 12 was prepared in the same manner of Example 8, except that BP8 replaced BP4 (in the same amount). The abrasive slurry of Example 12 was used in forming an abrasive article in the same manner described for Example 8.

The abrasive slurry of Example 13 was prepared in the same manner as Example 8 except that BP9 replaced BP4 (in the same amount) and the WAO ingredient used in Example 13 was 53.0 parts WAO where the sizing was changed to grade 4000 (3 micrometers). The abrasive slurry of Example 13 was used in forming an abrasive article in the same manner described for Example 8.

The abrasive slurry of Example 14 was prepared in the same manner as Example 8, except the WAO ingredient used in Example 14 was 60.0 parts WAO grade 6000 (2 micrometers), and the BP9 ingredient replaced BP4 and the BP9 was used in 37.6 parts. The abrasive slurry of Example 14 was used in forming an abrasive article in the same manner described for Example 8, except that the abrasive slurry was coated and cured at a line speed of 36.58 meters/min.

The Examples 12–14 were then tested in the same manner as Test Procedure 1, with the following changes: the machine used was a Coburn 5056 cylinder machine, the lens workpieces were made of 1.60 high index plastic workpiece, available from Silor (St. Petersburg, Fla.; and also the lens was fined two steps: for one minute with a 3M 314 Qwik Strip™ Paper Fining Pad (P600 A10), and thereafter for two minutes with a 3M 264M Qwik Strip™ fining pad film (12μ A/O Fine), both commercially available from 3M Company, St. Paul, Minn., to a finish of about 0.55 micrometers. The lenses were then polished with the abrasive articles of Examples 12–14.

Two or three separate lenses were polished with two or three separate samples, i.e. daisies, respectively, obtained from the abrasive article of each of Examples 12–14 to determine an average value for each example, as indicated in Table 9. The Rtm results from the tests, recorded in micrometers, are summarized in Table 9 below.

TABLE 9

| Test | Rtm 1 | Rtm 2 | Rtm 3 | Rtm ave |
|---|---|---|---|---|
| Example 12 | 0.30 | 0.29 | — | 0.295 |
| Example 13 | 0.29 | 0.28 | — | 0.285 |
| Example 14 | 0.26 | 0.30 | 0.28 | 0.28 |

As shown by these additional results, the vinyl ether binder systems not containing plasticizers provided abrasive composites which provide polishing characteristics in Rtm of 0.30 micrometers or less, which is a surface finish acceptable for hard coating.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method for polishing an optical quality surface comprising the step of:

providing an optical quality surface having a first major surface, said first major surface having an initial Rtm value of greater than 0.35 micrometers;

bringing said first major surface into a frictional contacting relationship with an abrasive article, wherein said abrasive article comprises a sheet-like structure having deployed on at least one major surface thereof a plurality of individual abrasive composites, each composite comprising a plurality of abrasive particles dispersed in a binder; and moving at least one of said contacting first major surface and abrasive article relative to each other in the presence of a liquid essentially free of abrasive particles in a manner and for a time effective to polish said first major surface to provide a finished surface having final Rtm value of 0.30 micrometers or less, the step of moving the first major surface and abrasive article relative to each other to erode the abrasive composites to bring a continuous supply of new abrasive particles in the abrasive composites into engagement with the first major surface; and removing essentially all abrasive particles eroded from the abrasive composites from an interface between the first major surface and the abrasive article so that polishing is substantially accomplished by the abrasive composites.

2. The method of claim 1, wherein said sheet-like structure comprises a backing layer and said binder provides the means of attachment of said composites to said backing layer.

3. The method of claim 1, wherein said binder is formed from a binder precursor cured via an addition polymerization mechanism.

4. The method of claim 3, wherein said binder precursor is cured via a free radical polymerization mechanism.

5. The method of claim 3, wherein said binder precursor is cured via a cationic polymerization mechanism.

6. The method of claim 3, wherein said binder precursor polymerized by exposure to radiation.

7. The method of claim 3, wherein said binder precursor is selected from the group consisting of (meth) acrylated urethanes, (meth) acrylated epoxies, ethylenically unsaturated compounds, aminoplast derivatives having pendant α, β-unsaturated carbonyl groups, isocyanurate derivatives having at least one pendant acrylate group, isocyanate derivatives having at least one pendant acrylate group, vinyl ethers, epoxy resins, and mixtures thereof.

8. The method of claim 5, wherein said binder precursor comprises a mixture of vinyl ether and a catalyst in an amount effective to initiate a cationic cure.

9. The method of claim 8, wherein sad vinyl ether has a molecular weight below 500.

10. The method of claim 8, wherein said mixture comprises 10 to 80 parts by weight abrasive particles per 100 parts by weight of abrasive particles and vinyl ether.

11. The method of claim 1, wherein said optical quality surface is selected from the group consisting of plastic and glass.

12. The method of claim 1, wherein said optical quality surface is a plastic lens selected from the group consisting of a polycarbonate lens, a polyester lens, a polymethyl methacrylate lens, a polyurethane lens and a polystyrene lens.

13. The method of claim 1, wherein said sheet-like structure comprises a backing layer selected from the group consisting of polymeric film, woven cloth, paper, and nonwoven.

14. The method of claim 1, wherein said sheet-like structure has a thickness of about 255 to 305 micrometers.

15. The method of claim 1, wherein said sheet-like structure comprises a backing layer composed of a paper layer saturated with an acrylic latex resin and having a thickness of about 255 to 305 micrometers.

16. The method of claim 1, wherein said sheet-like structure comprises a backing layer having a back side and an opposite front side for supporting said composites, wherein said back side includes means for attachment of said backing layer to a support means or a lap means.

17. The method of claim 16, wherein said attachment means is a pressure-sensitive adhesive.

18. The method of claim 1, wherein said abrasive particles and said binder are provided in a proportional amount of 95:5 to 5:95 parts by weight, respectively.

19. The method of claim 1, wherein of each said composite has a precise three dimensional shape defined by a substantially distinct discernible boundary.

20. The method of claim 1, wherein each composite includes a distal end spaced from said first major surface and said distal end is unconnected to any other composite.

21. The method of claim 19, wherein said precise shape of each composite is a geometrical shape selected from the group consisting of cubic, prismatic, conical, truncated conical, pyramidal, truncated pyramidal, spherical, and cylindrical.

22. The method of claim 1, wherein said composites have an area spacing on said major surface of at least 700 composites $cm^2$.

23. The method of claim 21, wherein said composites each further comprise a three dimensional shape selected from pyramidal and truncated pyramidal, and wherein said three dimensional shape includes an uppermost surface spaced through a vertical height from said first major surface, and a base side in planar contact with said first major surface and defined by base side lengths, wherein said height is in the range of from about 25 to about 200 micrometers and said base side lengths have a length of from about 100 to 500 micrometers.

24. The method of claim 1, wherein said initial Rtm value is from about 0.40 to 0.90 micrometers.

25. The method of claim 1, wherein said optical quality surface is transparent.

26. The method of claim 1, wherein said optical quality surface further comprises a second major surface which is opposite from said first major surface, wherein said first major surface is concavely shaped inwardly towards said second major surface.

27. The method of claim 26, wherein said optical quality surface comprises a lens having a shape selected from the group consisting of a concavo-convex, plus, minus and flat.

28. The method of claim 1, wherein said final Rtm value is less than 0.25 micrometers.

29. The method of claim 1, wherein said abrasive particles have a size between about 0.05 to about 4 micrometers and a Moh's hardness of at least about 8.

30. The method of claim 1, wherein said abrasive particles are selected from the group consisting of aluminum oxide, silicon carbide, chromia, alumina zirconia, diamond, iron oxide, ceria, boron nitride, boron carbide, garnet, and combinations thereof.

31. The method of claim 1, wherein said liquid comprises water.

32. A method of finishing an optical quality surface, comprising the steps of:

providing an optical quality surface having a first major surface, said first major surface having an initial Rtm value of greater than 0.35 micrometers;

bringing said first major surface into a frictional contacting relationship with an abrasive article, wherein said abrasive article comprises a sheet-like structure having deployed on at least one major surface thereof a plurality of abrasive particles dispersed in a binder forming a plurality of abrasive composites, wherein said binder is formed from a binder precursor comprising a resin polymerized via an addition mechanism;

moving at least one of said contacting first major surface and abrasive article relative to each other in the presence of a liquid essentially free of abrasive particles in a manner and for a time effective to polish said first major surface to a finished having a final Rtm value of 0.30 micrometers or less that is suitable for application thereon of a polymeric lens coating composition, the step of moving the first major surface and abrasive article relative to each other to erode the abrasive composites to bring a continuous supply of new abrasive particles on the abrasive composites into engagement with the first major surface; and removing essentially all abrasive particles eroded from the abrasive composites from an interface between the first major surface and the abrasive article so that polishing is substantially accomplished by the abrasive composites.

33. A method for polishing an optical quality surface comprising the step of:

providing an optical quality surface having a first major surface, said first major surface having an initial Rtm value of greater than 0.35 micrometers;

bringing said first major surface into a frictional contacting relationship with an abrasive article, wherein said abrasive article comprises a sheet-like structure having deployed on at least one major surface thereof a plurality of individual abrasive composites, each composite comprising a plurality of abrasive particles dispersed in a binder, the binder being selected from a group consisting of vinyl ethers and free radical curable resin with a plasticizer;

moving at least one of said contacting first major surface and abrasive article relative to each other in the presence of a liquid essentially free of abrasive particles in a manner and for a time effective to polish said first major surface to provide a finished surface having final Rtm value of 0.30 micrometers or less, the step of moving the first major surface and abrasive article relative to each other and to erode the abrasive composites to bring a continuous supply of new abrasive particles in the abrasive composites into engagement with the first major surface; and removing essentially all abrasive particles eroded from the abrasive composites from an interface between the first major surface and the abrasive article so that polishing is substantially accomplished by the abrasive composites.

* * * * *

UNITED STATES PATENT AND TRADEMARK OFFICE

CERTIFICATE OF CORRECTION

PATENT NO.: 5,632,668

DATED: May 27, 1997

INVENTOR(S): Gene O. Lindholm and Robert A. Follensbee

It is certified that error appears in the above-identified patent and that said Letters Patent is hereby corrected as shown below:

| | |
|---|---|
| Col. 5, line 10 | "Jumbo" should read --jumbo-- |
| Col. 8, line 20 | delete "the" |
| Col. 28, line 6 | "sad" should read --said-- |
| Col. 28, lines 50-51 | "700 composites $cm^2$" should read --700 composites/$cm^2$-- |
| Col. 30, line 30 | delete "and" |

Signed and Sealed this

Third Day of February, 1998

*Attest:*

Bruce Lehman

BRUCE LEHMAN

*Attesting Officer*

*Commissioner of Patents and Trademarks*